US009480372B1

(12) United States Patent
Taylor

(10) Patent No.: US 9,480,372 B1
(45) Date of Patent: Nov. 1, 2016

(54) PORTABLE TOWELETTE DISPENSER

(71) Applicant: Kyle Taylor, Summerville, SC (US)

(72) Inventor: Kyle Taylor, Summerville, SC (US)

( * ) Notice: Subject to any disclaimer, the term of this patent is extended or adjusted under 35 U.S.C. 154(b) by 0 days.

(21) Appl. No.: 14/855,459

(22) Filed: Sep. 16, 2015

Related U.S. Application Data

(63) Continuation-in-part of application No. 13/869,009, filed on Apr. 23, 2013, now abandoned.

(60) Provisional application No. 61/637,957, filed on Apr. 25, 2012.

(51) Int. Cl.
*A47K 10/42* (2006.01)
*A47K 10/32* (2006.01)

(52) U.S. Cl.
CPC ..... *A47K 10/42* (2013.01); *A47K 2010/3233* (2013.01); *A47K 2010/3273* (2013.01)

(58) Field of Classification Search
CPC ..... A47K 2010/3286; A47K 2010/3273
USPC ..... 221/96; 222/144, 187, 190, 464.2, 354, 222/355, 519, 520, 521, 553, 548, 549
See application file for complete search history.

(56) References Cited

U.S. PATENT DOCUMENTS 3,865,271 A * 2/1975 Gold ..... A47K 10/32 221/96
4,598,664 A * 7/1986 Hamlin ..... A47K 10/32 118/32
4,667,846 A * 5/1987 Marceau ..... A47K 10/32 221/34
D347,534 S 6/1994 Gottselig
5,765,717 A 6/1998 Gottselig
5,927,908 A * 7/1999 Kikuchi ..... A21C 9/04 222/553
6,098,836 A 8/2000 Gottselig
6,179,162 B1 * 1/2001 Motsenbocker ..... G07F 9/105 221/150 A
6,457,434 B1 * 10/2002 Lazar ..... A47K 10/32 118/314
6,578,731 B1 6/2003 Lewis et al.
6,903,307 B1 * 6/2005 McConnell ..... A47K 10/32 219/214
7,588,548 B2 9/2009 Kopreski
7,922,036 B2 4/2011 Bendor et al.
2004/0112367 A1 6/2004 Zaninelli
2004/0242097 A1 12/2004 Hasenoehrl et al.
2005/0205593 A1 9/2005 Young et al.
2006/0151513 A1 * 7/2006 Shadrach, III ..... A47K 10/3818 221/1
2006/0180596 A1 8/2006 Young et al.
2007/0215631 A1 9/2007 Bendor et al.
2007/0278242 A1 12/2007 Amundson et al.

(Continued)

OTHER PUBLICATIONS

Handbook of Cosmetic Science and Technology, 3rd ed., Andre' O. Barel, Marc Paye, Howard I. Maibach, eds., Informa Healthcare (Pub), New York, 2009.

*Primary Examiner* — Patrick Mackey
(74) *Attorney, Agent, or Firm* — Malloy & Malloy, P.L.

(57) ABSTRACT

A portable towelette dispenser includes a liquid container comprising a liquid cavity, and a base rotationally connected to the liquid container. A stem connected to the base in rotating relation thereto, wherein the liquid container may be disposed about the stem. The base may be operative to rotate the stem relative to the liquid container via rotation of the base relative to the liquid container. A wetting configuration of the portable towelette dispenser is at least partially defined by at least partial alignment of one or more stem apertures relative to one or more wetting apertures. A sealed configuration of the portable towelette dispenser is at least partially defined by a completely non-aligned relation of the stem apertures relative to the wetting apertures.

17 Claims, 5 Drawing Sheets

(56) References Cited

U.S. PATENT DOCUMENTS

2009/0031952 A1* 2/2009 Lazar ..... A47K 10/32 118/695
2010/0032443 A1* 2/2010 Mueller ..... A45D 34/00 221/2
2010/0191314 A1 7/2010 Young
2012/0225290 A1 9/2012 Hartmann et al.
2013/0105508 A1* 5/2013 Hess ..... A47K 10/42 221/46
2013/0126549 A1* 5/2013 Ader ..... A47K 10/24 221/96
2013/0306669 A1* 11/2013 Ray ..... A47K 10/24 221/63

* cited by examiner

PORTABLE TOWELETTE DISPENSER

BACKGROUND OF THE INVENTION

1. Field of the Invention

A portable towelette dispenser contains an amount of a refreshing liquid to be applied to a towelette at a time of use.

2. Description of the Related Art

Pre-moistened towelettes, wipes, and naps are generally known as well as various uses for same. However, such pre-moistened towelettes must be kept in a sealed environment or else they will eventually dry out. Such a requirement lends itself to packaging a bulk amount of moistened towelettes in a resealable packaging for use one by one. However, such bulk packaging is hardly portable. Accordingly, single pre-moistened towelettes are generally available in individual packaging, however, individual packaging is expensive and wasteful. Certain moistening preparations provide a cool, refreshing sensation to the skin while others assist in the cooling of the body via endothermic reactions.

As such, there is a need for a portable, efficient method of preparing and applying desired moistening preparations at a desired time. The present invention addresses these needs, as well as others, as disclosed herein.

SUMMARY OF THE INVENTION

The present invention is directed to a portable towelette dispenser capable of storing and retaining at least one towelette, wetting the towelette at a desired time, and dispensing the towelette to a user. In at least one embodiment, a towelette is wetted with a liquid that is stored in a liquid container of the dispenser. In a further embodiment, the liquid may comprise a refreshing liquid in order to provide a refreshing sensation to a user and/or cool the body of a user.

In one embodiment the portable towelette dispenser comprises a base, a stem, and a liquid container. The liquid container is disposed about the stem and the stem is movable relative to the liquid container via movement of the base. In at least one embodiment, the stem rotates relative to the liquid container concurrent to rotation of the base.

In one embodiment, the stem includes a retention channel for receipt and retention of a towelette, and in one further embodiment, the stem also includes a plurality of stem apertures disposed through the stem to facilitate liquid communication between the liquid container and a towelette retained in a retention channel. A seal is disposed about and is movable with the stem, in at least one embodiment. The seal includes one or more seal apertures of substantially the same dimension and configuration as the stem apertures.

Accordingly, in one embodiment, a liquid container comprises a generally elongated toroidal shape, which includes an inner wall, an outer wall, a cap, and a base, collectively defining a liquid cavity. Furthermore, one or more wetting apertures are disposed on the inner wall to facilitate transfer of liquid from the liquid cavity to the retention channel of the stem. In at least one embodiment, the wetting apertures comprise substantially the same dimensions and configuration as the stem apertures and corresponding seal apertures. As such, the stem may be moved relative to the liquid container, moving the stem apertures, and corresponding seal apertures, into and out of alignment with the wetting apertures. As such, a completely non-aligned configuration of stem and seal apertures relative to the wetting apertures at last partially defines a sealed configuration, as liquid is essentially restricted from entering the retention channel, due to an abutting relation of the seal against the inner wall of the liquid container. Conversely, an at least partially aligned configuration of the stem and seal apertures relative to the wetting apertures at least partially defines a wetting configuration, as liquid is allowed to be transferred from the liquid container into the retention channel, where, during use of the invention, a towelette to be wetted is retained.

In at least some embodiments, the present portable towelette dispenser comprises a specially formed towelette that is compressed to be inserted into the retention channel of the stem and is retained therein until ready for use. In one embodiment, the towelette is compressed to a predetermined dimension and configuration to assure a snug friction fit within the retention channel, in order to prevent inadvertent release of the towelette from the retention channel, even while the dispenser is exposed to vigorous movement by a user.

In at least one embodiment, the liquid container of the present invention is refillable, either with water or a refreshing liquid including one or more chemicals designed to provide a cooling sensation upon contact with a user's skin, such as a mint oil, or any of a variety of other known substances capable of endothermic reactions, or both. In one further embodiment, a predetermined refreshing liquid is provided in a preformed pack that can be inserted into the liquid cavity. In such an embodiment, the dispenser breaks the preformed pack upon movement of the dispenser from a sealed configuration into a wetting configuration. In yet one further embodiment, the container is first manipulated into a sealed configuration and a liquid is added to the liquid container to be stored until used. When so desired, the wetting configuration is achieved by manipulating the dispenser to achieve an at least partial alignment of the apertures in the stem with the wetting apertures in the liquid container.

In at least one embodiment, as stated above, the liquid may comprise a refreshing liquid. Such a refreshing liquid may provide a cooling sensation when applied to a user's skin, be capable of producing an endothermic reaction, or both. By way of non-limiting example, the predetermined refreshing liquid may be a solution of one or more of the following: water; ethanol; menthol; N-ethyl-p-menthane-3-carboxamide; 2-isopropyl-N 2,3 trimethylbutyramide; ethyl 3-(p-menthane-3-carboxamido)acetate; alicyclic amides; cyclic carboxamides; N-substituted paramenthane carboxamides; acyclic carboxamides; cyclic amides; cyclic substituted ureas; phosphine oxides; alkyl-substituted methanols; 3-substituted-p-menthanes, cyclic sulphonamides; acyclic sulphonamides; cyclic sulphinamides; acyclic sulphinamides; N-(4-cyanomethylphenyl)-p-menthanecarboxamide; N-(2-(Pyridin-2-yl)ethyl)-3-p-menthanecarboxamide; cyclopropanecarboxylic acid (2-isopropyl-5-methyl-cyclohexyl)-amide; N-ethyl-2,2-diisopropylbutanamide; N-(2-hydroxyethyl)-2-isopropyl-2,3dimethylbutanamide; N-(1,1-dimethyl-2-hydroxyethyl)-2,2-diethylbutanamide; monomenthyl succinate; alkali metal salt of monomenthyl succinate; alkaline earth metal salts of monomenthyl succinate; Perillartine; Icillin; and the like.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

Figure 1:
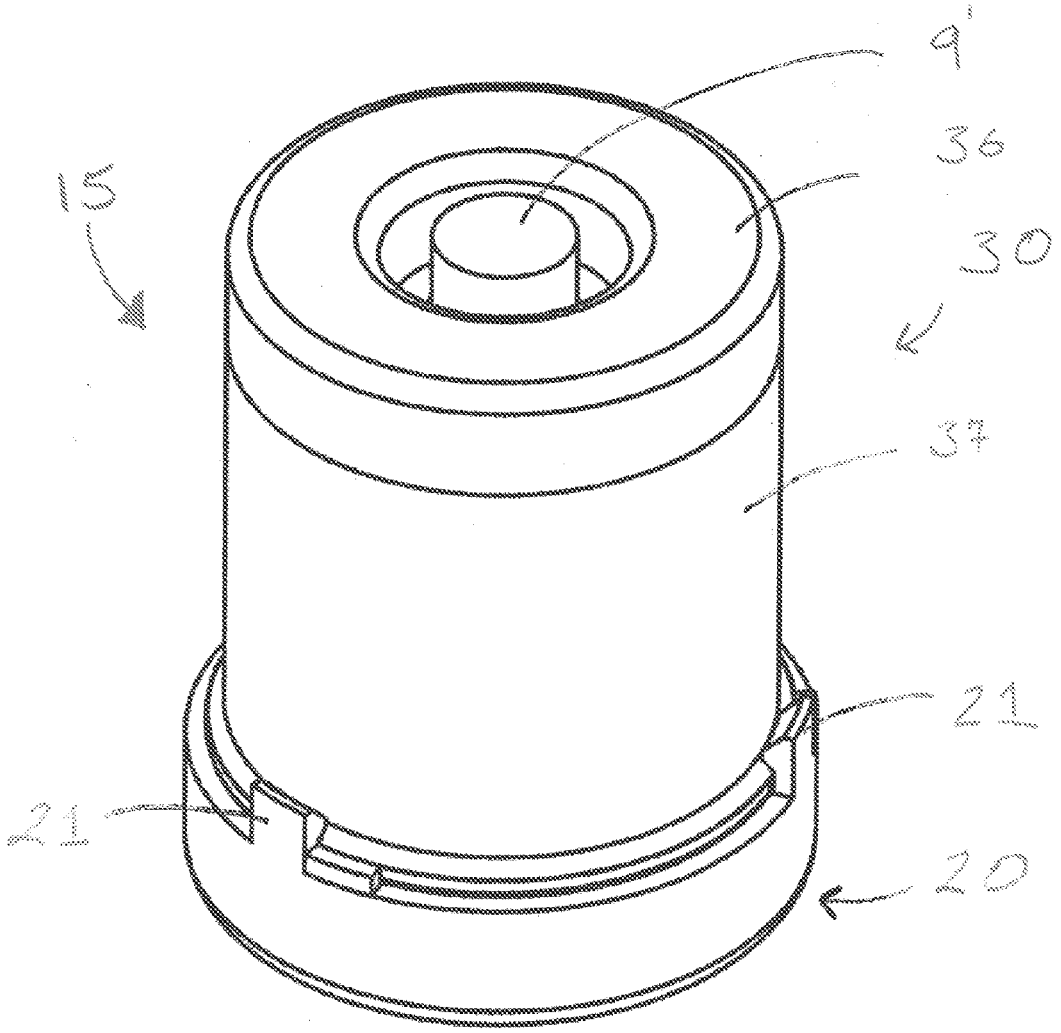
FIG. 1 is a perspective view of one illustrative embodiment of a portable towelette dispenser with a towelette retained therein in accordance with the present invention.
Figure 4:
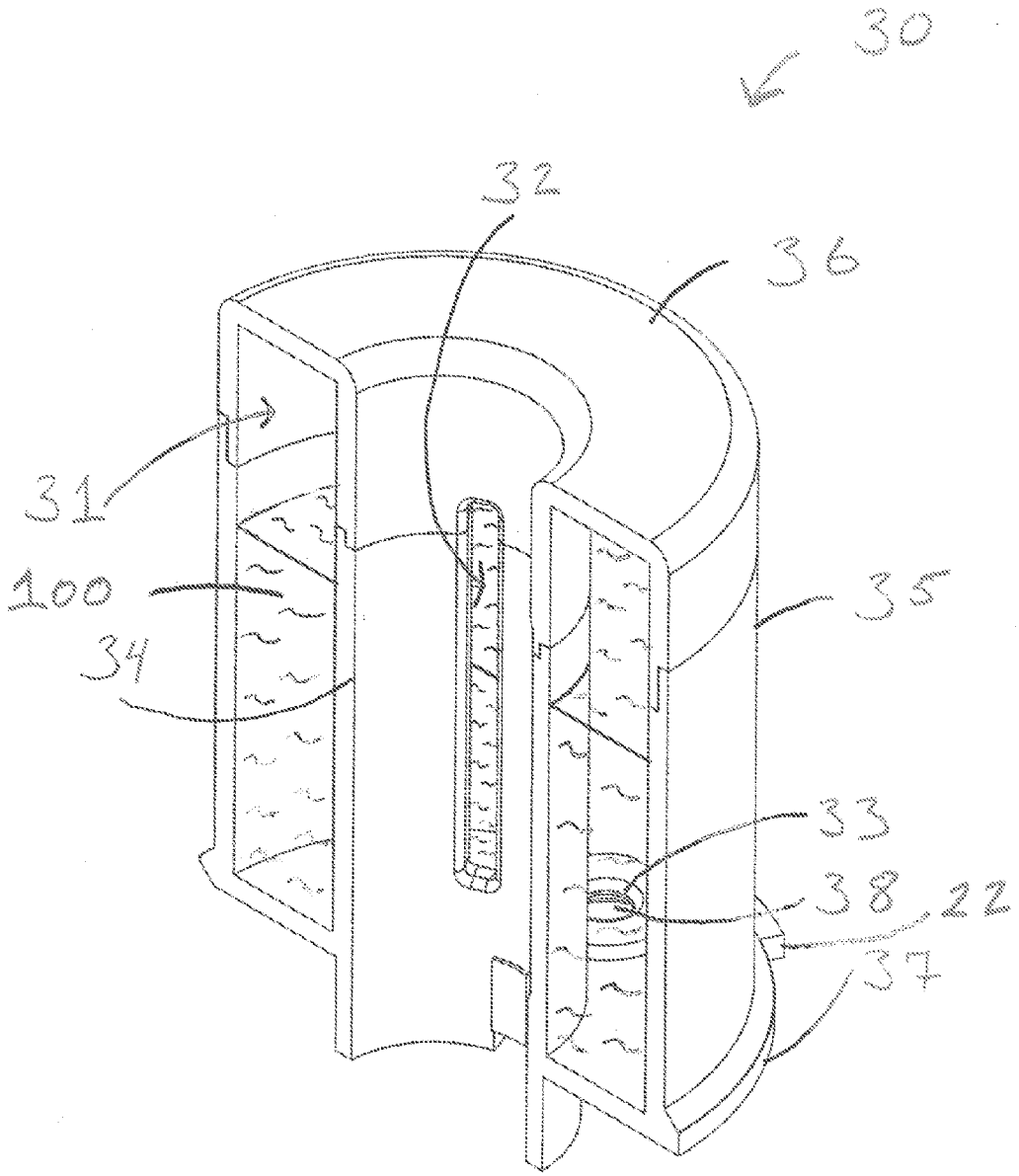
FIG. 4 is a perspective section view of one illustrative embodiment of a liquid container of a portable towelette dispenser partially filled with a liquid in accordance with the present invention.

FIG. 1 is a perspective view of a portable towelette dispenser 15 in accordance with one embodiment of the present invention. As can be seen, the dispenser 15 includes a base 20 and a liquid container 30. In the depicted embodiment, the liquid container 30 comprises a cap 36 and bottom 37. As such, the cap 36 may be removably disposable on the bottom 37 in order to facilitate disposition of liquid within the liquid container 30. In alternative embodiments, the cap 36 may be adhered to the bottom 37 and an alternative port, represented as 33 in FIG. 4, is provided for disposition of liquid within the liquid container 30.

Also depicted in FIG. 1 is a towelette 9', according to one embodiment of the invention, which is shown inserted within the dispenser 15 for storage as well as wetting of the towelette 9' when desired. In at least some embodiments, a towelette 9' is rolled or otherwise compacted by a user so as to fit within the dispenser 15. In one embodiment, a towelette 9' is pre-compacted to specified dimensions and provided in such a pre-compacted state.

Figure 2:
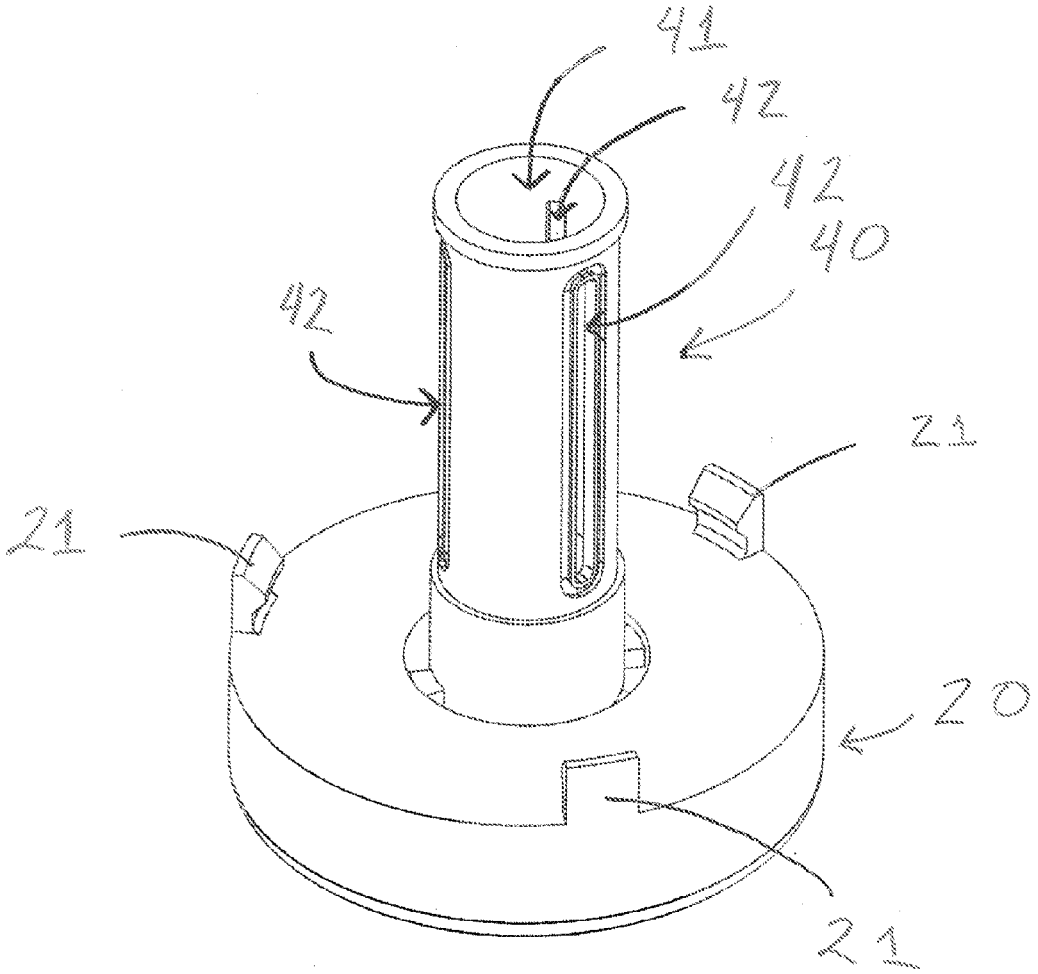
FIG. 2 is a perspective view of one illustrative embodiment of a base and a stem of a portable towelette dispenser in accordance with the present invention.

FIG. 2 is a perspective view of a base 20 and stem 40 of a portable towelette dispenser 15 in accordance with one embodiment of the present invention. As can be seen in FIG. 2, the stem 40 includes a retention channel 41 for receiving and retaining a towelette 9' (not shown). The stem 40 also includes one or more stem apertures 42 which, as will be described in more detail hereinafter, facilitate transfer of liquid to the towelette 9' when the dispenser 15 is disposed in a wetting configuration. In at least one embodiment, the stem 40 is interconnected with the base 20, or at least drivingly engaged by the base 20, such that a movement of the base 20 causes movement of the stem 40. In a one further embodiment, rotation of the base 20 causes a concurrent rotation of the stem 40.

Figure 3:
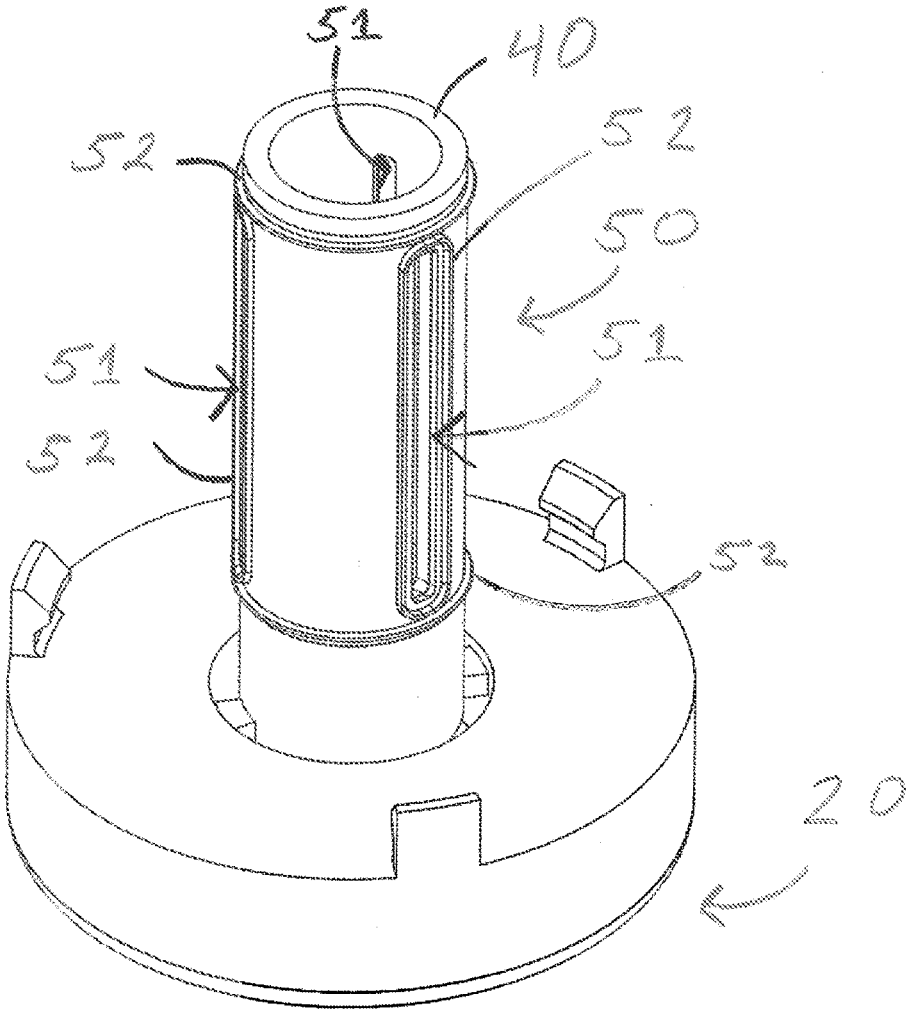
FIG. 3 is a perspective view of one illustrative embodiment of a base, a stem, and a seal of a portable towelette dispenser in accordance with the present invention.

FIG. 3 is a perspective view of a base 20, a stem 40, and a seal 50 of a portable towelette dispenser 15 in accordance with the embodiment depicted in FIG. 2. As shown in FIG. 3, the seal 50 is disposed about the stem 40. The seal 50 also includes at least one seal aperture 51, and in at least one embodiment, such as is shown in FIG. 3, the seal 50 comprises a plurality of seal apertures 51. In at least one embodiment, the number of seal apertures 51 is equal to the number of stem apertures 42 and each of the plurality of seal apertures 51 is disposed in alignment with a corresponding one of the plurality of stem apertures 42, so as to avoid obstructing the transfer of a liquid 100 into the stem 40 when the dispenser 15 is disposed in a wetting configuration. The seal 50 may also include a flange 52 disposed about a periphery of a seal aperture 51 to provide a fluid resistant seal between the stem 20 and the liquid container 30, as will become apparent with reference to the additional figures herein.

FIG. 4 is a section view of a liquid container 30 in accordance with one embodiment of the present invention. As can be seen from the illustrative embodiment of FIG. 4, the liquid container 30 includes a cap 36, bottom 37, interior wall 34, exterior wall 35, liquid cavity 31, port 33, plug 38, and a plurality of wetting apertures 32. Only one wetting aperture 32 is visible in FIG. 4 due to the section on which the view is taken. As additionally can be seen from FIG. 4, the liquid cavity 31 is partially filled with liquid 100 to be utilized when the dispenser 15 is disposed into a wetting configuration. As previously discussed, liquid 100 may be introduced into the liquid cavity 31 either via the port 33 or via removal of the cap 36 from the bottom 37. Additionally, a plug 38 is removably disposed within the port 33 to facilitate refilling of the liquid in certain embodiments were a cap 36 is not utilized or not desired.

In one embodiment, the number of wetting apertures 32 is equal to the number of stem apertures 42 and seal apertures 51. Additionally, the configuration of wetting apertures 32 are such that, when the liquid container 30 is disposed about the stem 20 and the seal 50, the wetting apertures 32 may be either fully or at least partially aligned, as in a wetting configuration, or completely non-aligned, as in a sealed configuration.

Figure 5:
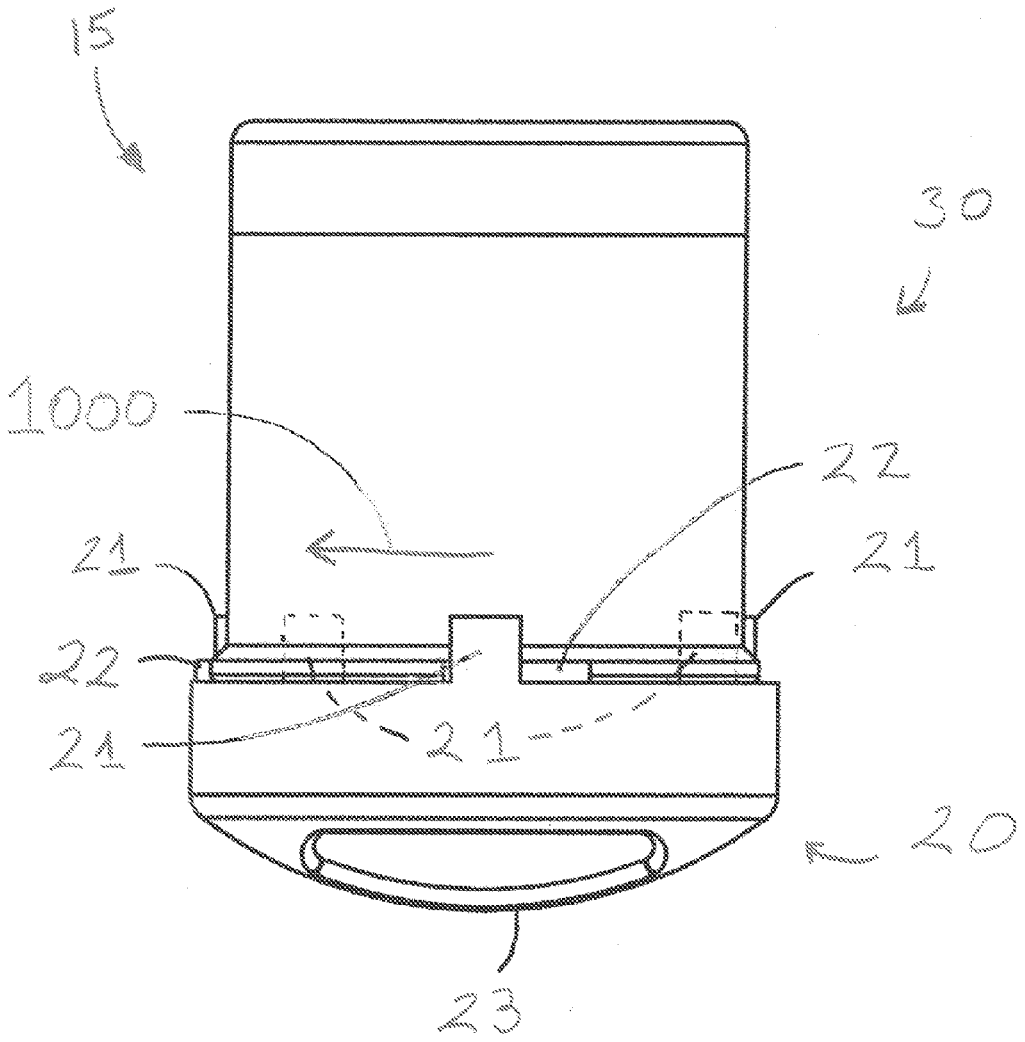
FIG. 5 is an elevation of one illustrative embodiment of a portable towelette dispenser invention in accordance with the present.

FIG. 5 presents an elevation of one illustrative embodiment of a portable towelette dispenser 15 in accordance with the present invention. More in particular, FIG. 5 illustrates the position of a plurality of interconnects 21, depicted in solid lines, when the portable towelette dispenser 15 is disposed in a sealed configuration, whereby the wetting apertures 32 are completely non-aligned relative to the stem 42 apertures and seal apertures 51. However, by rotating the base 20 relative to the liquid container 30 in the direction of arrow 1000, the stem 40 and seal 50 are also rotated with the base 20, and the wetting apertures 32 are rotated into at least partial alignment with the stem and seal apertures 42 and 51, respectively, thereby allowing liquid to be transferred from the liquid cavity 31 to the towelette 9' located within the retaining channel 41. The plurality of interconnects 21 are repositioned, as shown in dashed lines, when the portable towelette dispenser 15 is disposed into a wetting configuration. As will be appreciated, rotating the base 20 in the opposite direction of arrow 1000 will return the dispenser 15 into a sealed configuration.

In at least one embodiment, stops 22 are disposed on the liquid container 30, as may be seen in FIGS. 4 and 5. Each stop 22 comprises a protruding element dimensioned and configured to obstruct movement of a corresponding interconnect 21. Accordingly, a limited angle of rotation of the base 20 relative to the liquid container 30 can be established in order to avoid over-rotation of the same beyond a sealed configuration. Additionally, the stops 22 facilitate disposition of the invention into a wetting configuration as the stops 22 prevent rotation of the wetting apertures past the stem and seal apertures, thereby facilitating alignment of the same.

As also shown in FIG. 5, in at least one embodiment of the present invention the base 20 includes a loop 23 of sufficient dimensions to provide for attachment to a key ring, clip, or lanyard, to enhance portability of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A portable towelette dispenser comprising:

a base, a stem interconnected to said base in a driven relation thereto, said stem comprising at least one stem aperture, a liquid container movably connected to said base, said liquid container disposed about said stem and comprising at least one wetting aperture, and said base, said liquid container, and said stem cooperatively actuable between a sealed configuration and a wetting configuration, wherein said wetting configuration is at least partially defined by said stem aperture moved into at least partial alignment with said wetting aperture, thereby facilitating transfer of a liquid from said wetting aperture through said stem aperture.

2. The portable towelette dispenser as recited in claim 1 further comprising a seal disposed at least partially between said liquid container and said stem.

3. The portable towelette dispenser as recited in claim 2 wherein said stem is movable with said base relative to said liquid dispenser.

4. The portable towelette dispenser as recited in claim 3 wherein said sealed configuration is at least partially defined by a completely non-aligned disposition of said at least one stem aperture relative to said at least one wetting aperture.

5. The portable towelette dispenser as recited in claim 1 wherein said stem further comprises a retention channel for receiving and retaining a towelette.

6. The portable towelette dispenser as recited in claim 1 wherein a rotation of said base causes a concurrent rotation of said stem.

7. The portable towelette dispenser as recited in claim 1 wherein said wetting configuration is further defined by rotating said base until said at least one stem aperture is at least partially aligned relative to said at least one wetting aperture.

8. The portable towelette dispenser as recited in claim 7 wherein said sealed configuration is at least partially defined by rotating said base until said at least one stem aperture is completely non-aligned relative to said at least one wetting aperture.

9. A portable towelette dispenser comprising:

a liquid container comprising a liquid cavity, a base, a stem comprises a retention channel and is interconnected to said base in a rotating relation thereto, said liquid container rotationally connected to said base, said liquid container comprises a plurality of wetting apertures and is disposed about said stem, and said base being operative to rotate said stem relative to said liquid container concurrent to a rotation of said base relative to said liquid container.

10. The portable towelette dispenser as recited in claim 9 wherein said stem further comprises a plurality of stem apertures.

11. The portable towelette dispenser as recited in claim 10 further comprising a wetting configuration at least partially defined by an alignment of said wetting apertures with said stem apertures facilitating transfer of said liquid from said liquid cavity to said retention channel.

12. The portable towelette dispenser as recited in claim 10 further comprising a seal disposed between said stem and said liquid container.

13. The portable towelette dispenser as recited in claim 12 further comprising a sealed configuration at least partially defined by a completely non-aligned disposition of said stem apertures and said wetting apertures; said seal being operative to restrict liquid transfer to said retention channel.

14. A system for portably dispensing towelettes comprising:

a portable towelette dispenser comprising at least a base, a liquid container, and a stem, said liquid container rotationally disposed about said stem, said base connected to said stem in rotating relation thereto, said liquid container comprising a plurality of wetting apertures and a liquid cavity for retaining a liquid, said stem comprising a plurality of stem apertures and a retention channel, a towelette disposable into said towelette retention channel, wherein a rotation of said base is operative to dispose said portable towelette dispenser into a wetting configuration, said wetting configuration at least partially defined by an at least partially aligned disposition of said plurality of stem apertures and said plurality of wetting apertures, thereby facilitating transfer of said liquid from said liquid cavity to said towelette.

15. The system as recited in claim 14 further comprising a seal disposed between said liquid container and said stem.

16. The system as recited in claim 15 further comprising a sealed configuration at least partially defined by a completely non-aligned disposition of said plurality of wetting apertures relative to said plurality of stem apertures, said seal operative to restrict transfer of said liquid to said towelette when in said sealed configuration.

17. The system as recited in claim 14 wherein said transfer of said liquid is accomplished via flow of liquid from said liquid cavity through said at least partial alignment of said plurality of stem apertures and said plurality of wetting apertures.

* * * * *